US010132136B2

(12) United States Patent
Veit

(10) Patent No.: US 10,132,136 B2
(45) Date of Patent: Nov. 20, 2018

(54) DOWNHOLE FLUID FLOW CONTROL SYSTEM AND METHOD HAVING AUTONOMOUS CLOSURE

(71) Applicant: Halliburton Energy Services, Inc., Houston, TX (US)

(72) Inventor: Jan Veit, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 299 days.

(21) Appl. No.: 14/325,633

(22) Filed: Jul. 8, 2014

(65) Prior Publication Data

US 2015/0021019 A1 Jan. 22, 2015

(51) Int. Cl.
*E21B 34/08* (2006.01)
*E21B 43/08* (2006.01)
*E21B 43/12* (2006.01)

(52) U.S. Cl.
CPC ..... *E21B 34/08* (2013.01); *E21B 43/08* (2013.01); *E21B 43/12* (2013.01)

(58) Field of Classification Search
CPC ..... E21B 34/06; E21B 34/08; E21B 43/08; E21B 43/12
See application file for complete search history.

(56) References Cited

U.S. PATENT DOCUMENTS 4,844,113 A * 7/1989 Jones ..... F16K 17/363 137/39
2008/0041452 A1* 2/2008 Zweber ..... F16K 11/105 137/12
2011/0297385 A1 12/2011 Dykstra et al.
2012/0181037 A1 7/2012 Holderman
2012/0211243 A1 8/2012 Dykstra et al.
2012/0227839 A1 9/2012 Veit
2012/0255351 A1 10/2012 Dykstra

FOREIGN PATENT DOCUMENTS

WO WO 2014007804 A1 * 1/2014 ..... E21B 21/103

OTHER PUBLICATIONS

International Search Report and Written Opinion, KIPO, PCT/US2013/051251, dated Apr. 15, 2014.

* cited by examiner

*Primary Examiner* — Taras P Bemko
*Assistant Examiner* — Manuel C Portocarrero

(57) ABSTRACT

A fluid flow control system includes a flow control assembly having a fluid flow path for a flowing fluid. First and second flow control components are disposed in parallel in the fluid flow path, the first having a positive flowrate response to decreasing fluid viscosity and the second having a negative flowrate response to decreasing fluid viscosity. A valve is disposed in the fluid flow path in downstream series with the first and second flow control components. The valve has first and second inlet paths for fluid from the first and second flow control components, respectively, such that decreasing the fluid viscosity of the flowing fluid increases a ratio of the flowrate through the first control component to the flowrate through the second flow control component and such that when the ratio reaches a predetermined level, the valve autonomously shifts from an open position to a closed position.

18 Claims, 6 Drawing Sheets

DOWNHOLE FLUID FLOW CONTROL SYSTEM AND METHOD HAVING AUTONOMOUS CLOSURE

CROSS-REFERENCE TO RELATED APPLICATIONS

This application claims the benefit under 35 U.S.C. § 119 of the filing date of International Application No. PCT/US2013/051251, filed Jul. 19, 2013.

TECHNICAL FIELD OF THE DISCLOSURE

This disclosure relates, in general, to equipment utilized in conjunction with operations performed in subterranean wells and, in particular, to a downhole fluid flow control system and method having autonomous closure for controlling the inflow of an undesired production fluid.

BACKGROUND OF THE DISCLOSURE

Without limiting the scope of the present disclosure, its background will be described with reference to producing fluid from an unconsolidated or loosely consolidated hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flowrate and/or composition of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flowrate through these flow control screens is substantially fixed prior to installation by the number and design of the flow control components.

It has been found, however, that due to changes in formation pressure and changes in formation fluid composition over the life of the well, it may be desirable to adjust the flow control characteristics of the flow control sections. In addition, for certain completions, such as long horizontal completions having numerous production intervals, it may be desirable to independently control the inflow of production fluids into each of the production intervals. Further, in some completions, it would be desirable to adjust the flow control characteristics of the flow control sections without the requirement for well intervention.

Accordingly, a need has arisen for a flow control screen that is operable to control the inflow of formation fluids in a completion requiring sand control. A need has also arisen for flow control screens that are operable to independently control the inflow of production fluids from multiple production intervals. Further, a need has arisen for such flow control screens that are operable to control the inflow of production fluids without the requirement for well intervention as the composition of the fluids produced into specific intervals changes over time.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION OF THE DISCLOSURE

Figure 1:
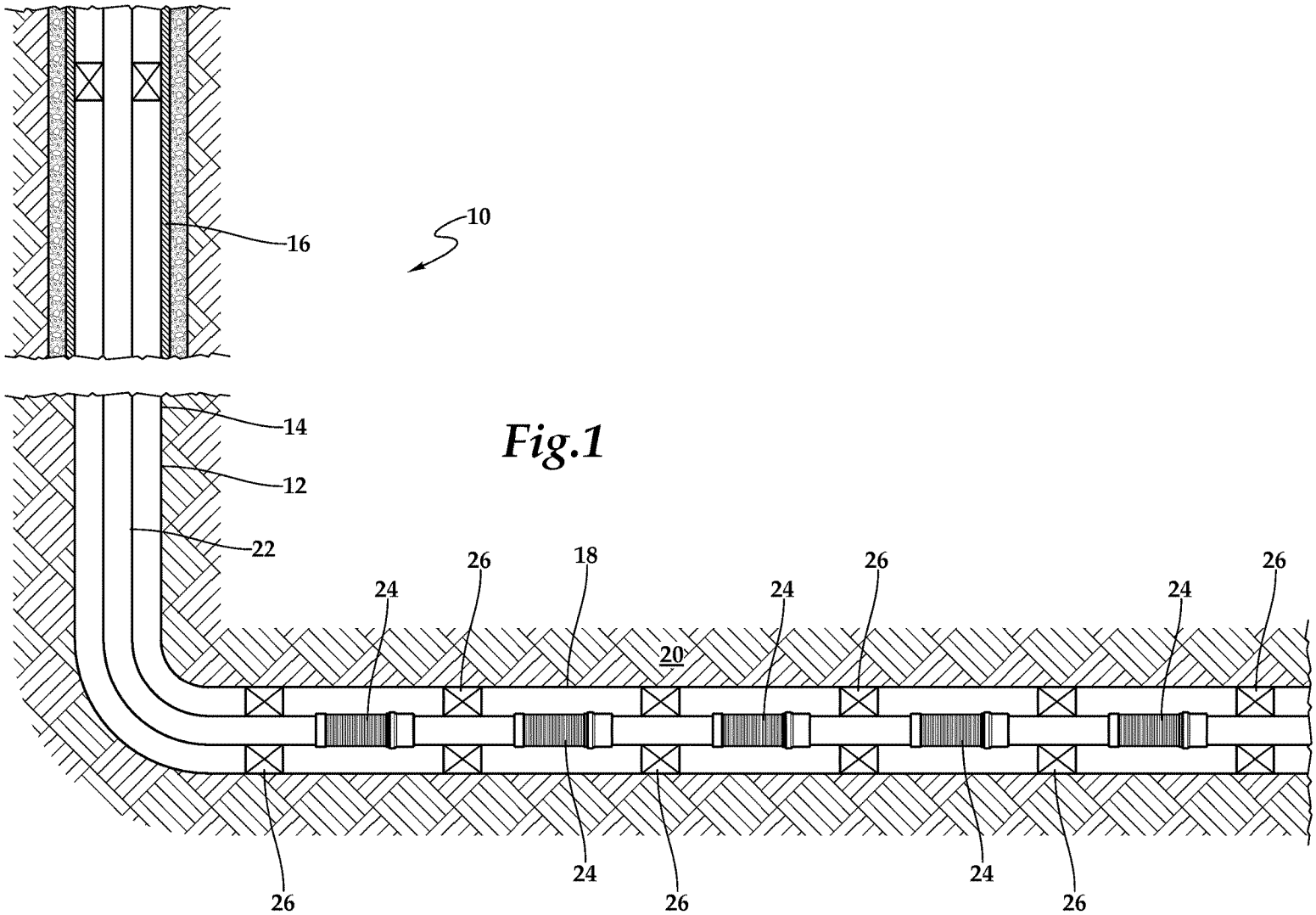
FIG. 1 is a schematic illustration of a well system operating a plurality of flow control screens according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

The present disclosure is directed to a downhole fluid flow control system that may be embodied in a flow control screen that is operable for controlling the inflow of production fluids. In addition, the downhole fluid flow control system of the present disclosure is operable to independently control the inflow of production fluids into multiple production intervals without the requirement for well intervention as the composition of the fluids produced into specific intervals changes over time.

In one aspect, the present disclosure is directed to a downhole fluid flow control system that includes a flow control assembly having a fluid flow path for a flowing fluid. A first flow control component is disposed in the fluid flow path. The first flow control component has a positive flowrate response to decreasing fluid viscosity. A second flow control component is disposed in the fluid flow path in parallel with the first flow control component. The second flow control component has a negative flowrate response to decreasing fluid viscosity. A valve is disposed in the fluid flow path in series with and downstream of the first and second flow control components. The valve has a first inlet path for fluid from the first flow control component and a second inlet path for fluid from the second flow control component, such that decreasing the fluid viscosity of the flowing fluid increases a ratio of the flowrate through the first control component to the flowrate through the second flow control component and such that when the ratio reaches a predetermined level, the valve autonomously shifts from an open position to a closed position.

In one embodiment, the first and second flow control components may have viscosity dependent fluid flow resistance. In certain embodiments, the first flow control component may be selected from the group consisting of nozzles, flow tubes, labyrinths and fluid selectors. In some embodiments, the second flow control component may be selected from the group consisting of vortex chambers, fluid selectors, fluid disrupters and fluid diodes. In one embodiment, the valve may include a valve seat, a plug and a magnet. In this embodiment, the magnet may support the plug remote from the valve seat when the valve is in the open position. Also, in this embodiment, fluid flow into the first inlet path of the valve from the first flow control component may bias the plug toward the valve seat and fluid flow into the second inlet path of the valve from the second flow control component may bias the plug away from the valve seat. In certain embodiments, the first inlet path may include a plurality of first inlet openings and the second inlet path may include a plurality of second inlet openings. In some embodiments, fluid flow into the first inlet path of the valve from the first flow control component may enter the valve in at least one substantially longitudinal direction and fluid flow into the second inlet path of the valve from the second flow control component may enter the valve in at least one substantially radial direction.

In another aspect, the present disclosure is directed to a flow control screen that includes a base pipe with an internal passageway, a filter medium positioned around the base pipe and a housing positioned around the base pipe defining a fluid passageway between the filter medium and the internal passageway. A flow control assembly is positioned in the fluid passageway. The flow control assembly has a fluid flow path for a flowing fluid. A first flow control component is disposed in the fluid flow path. The first flow control component has a positive flowrate response to decreasing fluid viscosity. A second flow control component is disposed in the fluid flow path in parallel with the first flow control component. The second flow control component has a negative flowrate response to decreasing fluid viscosity. A valve is disposed in the fluid flow path in series with and downstream of the first and second flow control components. The valve has a first inlet path for fluid from the first flow control component and a second inlet path for fluid from the second flow control component, such that decreasing the fluid viscosity of the flowing fluid increases a ratio of the flowrate through the first control component to the flowrate through the second flow control component and such that when the ratio reaches a predetermined level, the valve autonomously shifts from an open position to a closed position.

In a further aspect, the present disclosure is directed to a downhole fluid flow control method. The method includes positioning a fluid flow control system at a target location downhole, the fluid flow control system includes a flow control assembly having a fluid flow path for a flowing fluid, first and second flow control components disposed in parallel in the fluid flow path, the first flow control component having a positive flowrate response to decreasing fluid viscosity and the second flow control component having a negative flowrate response to decreasing fluid viscosity and a valve disposed in the fluid flow path in series with and downstream of the first and second flow control components, the valve having first and second inlet paths for fluid from the first and second flow control components, respectively; flowing fluid through the fluid flow path of the flow control assembly through the first and second flow control components and the valve; decreasing the fluid viscosity of the flowing fluid; increasing a ratio of the flowrate through the first control component to the flowrate through the second flow control component; reaching a predetermined ratio of the flowrates; and autonomously shifting the valve from an open position to a closed position.

The method may also include decreasing an oil to water ratio of the flowing fluid; maintaining the valve in the open position by magnetically supporting a plug remote from a valve seat of the valve; biasing the plug toward the valve seat responsive to fluid flow into the first inlet path of the valve from the first flow control component and biasing the plug away from the valve seat responsive to fluid flow into the second inlet path of the valve from the second flow control component; flowing fluid into a plurality of first inlet openings of the first inlet path and flowing fluid into a plurality of second inlet openings of the second inlet path and/or flowing fluid in at least one substantially longitudinal direction into the first inlet path of the valve from the first flow control component and flowing fluid in at least one substantially radial direction into the second inlet path of the valve from the second flow control component.

Referring initially to FIG. 1, therein is depicted a well system including a plurality of downhole fluid flow control systems positioned in flow control screens embodying principles of the present disclosure that is schematically illustrated and generally designated 10. In the illustrated embodiment, a wellbore 12 extends through the various earth strata. Wellbore 12 has a substantially vertical section 14, the upper portion of which includes a casing string 16 cemented therein. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screens 24 also has a flow control section that is operable to control fluid flow therethrough including shutting off production therethrough. As explained in greater detail below, the flow control sections are operable to control the inflow of production fluids into each production interval over the life of the well without the requirement for well intervention as the composition of the fluids produced into specific intervals changes over time in order to maximize production of a desired fluid such as oil and minimize production of an undesired fluid such as water.

Even though FIG. 1 depicts the disclosed flow control screens in an open whole environment, it should be understood by those skilled in the art that the disclosed flow control screens are equally well suited for use in cased wells. Also, even though FIG. 1 depicts one flow control screen in each production interval, it should be understood by those skilled in the art that any number of flow control screens may be deployed within a production interval without departing from the principles of the present disclosure. In addition, even though FIG. 1 depicts the flow control screens in a horizontal section of the wellbore, it should be understood by those skilled in the art that the disclosed flow control screens are equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though FIG. 1 depicts the flow control components associated with flow control screens in a tubular string, it should be understood by those skilled in the art that the disclosed flow control components need not be associated with a flow control screen or be deployed as part of the tubular string. For example, one or more flow control components may be deployed and removably inserted into the center of the tubing string or side pockets of the tubing string.

Figure 2A:
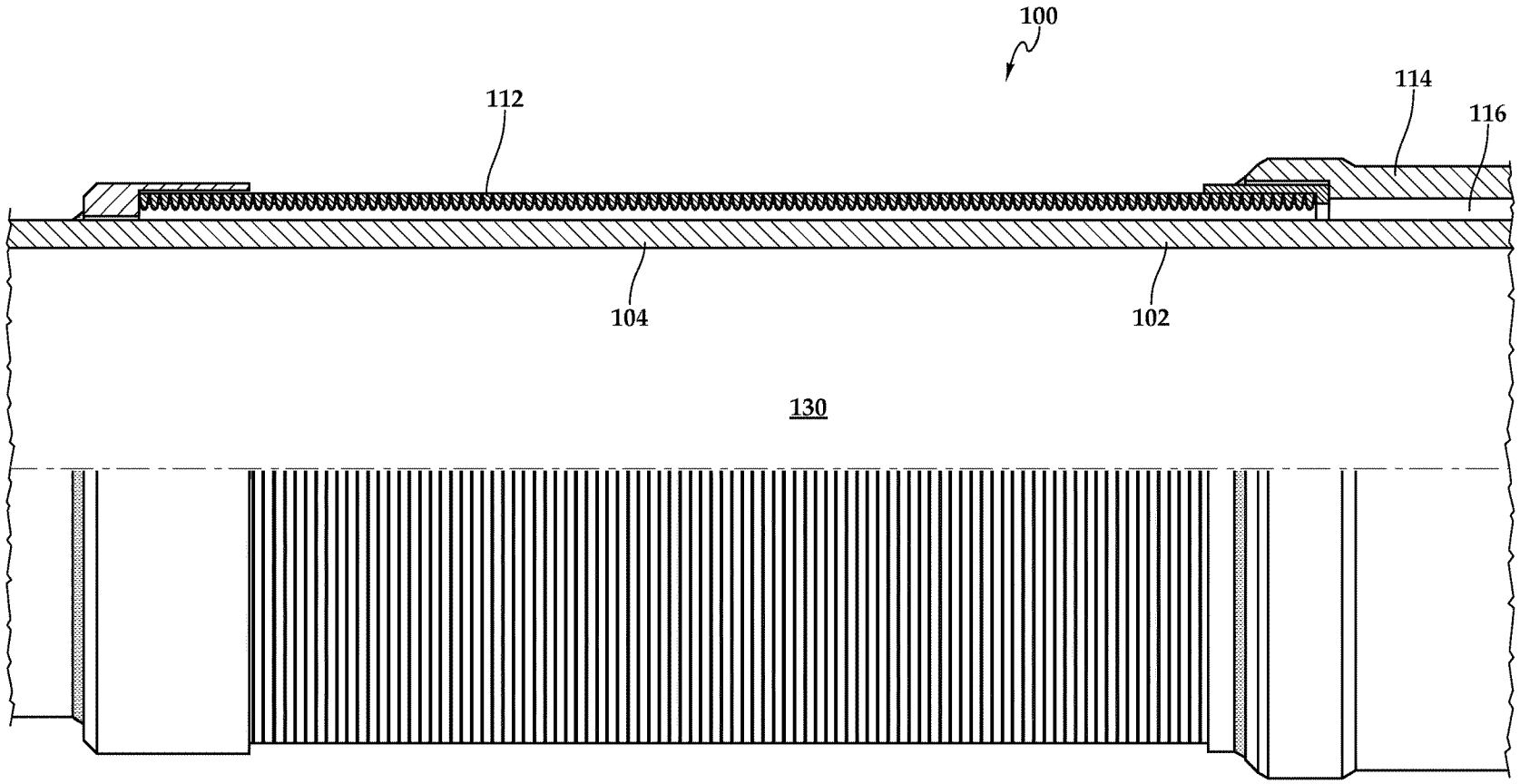
FIGS. 2A-2B are quarter sectional views of successive axial sections of a downhole fluid flow control system embodied in a flow control screen according to an embodiment of the present disclosure.
Figure 2B:
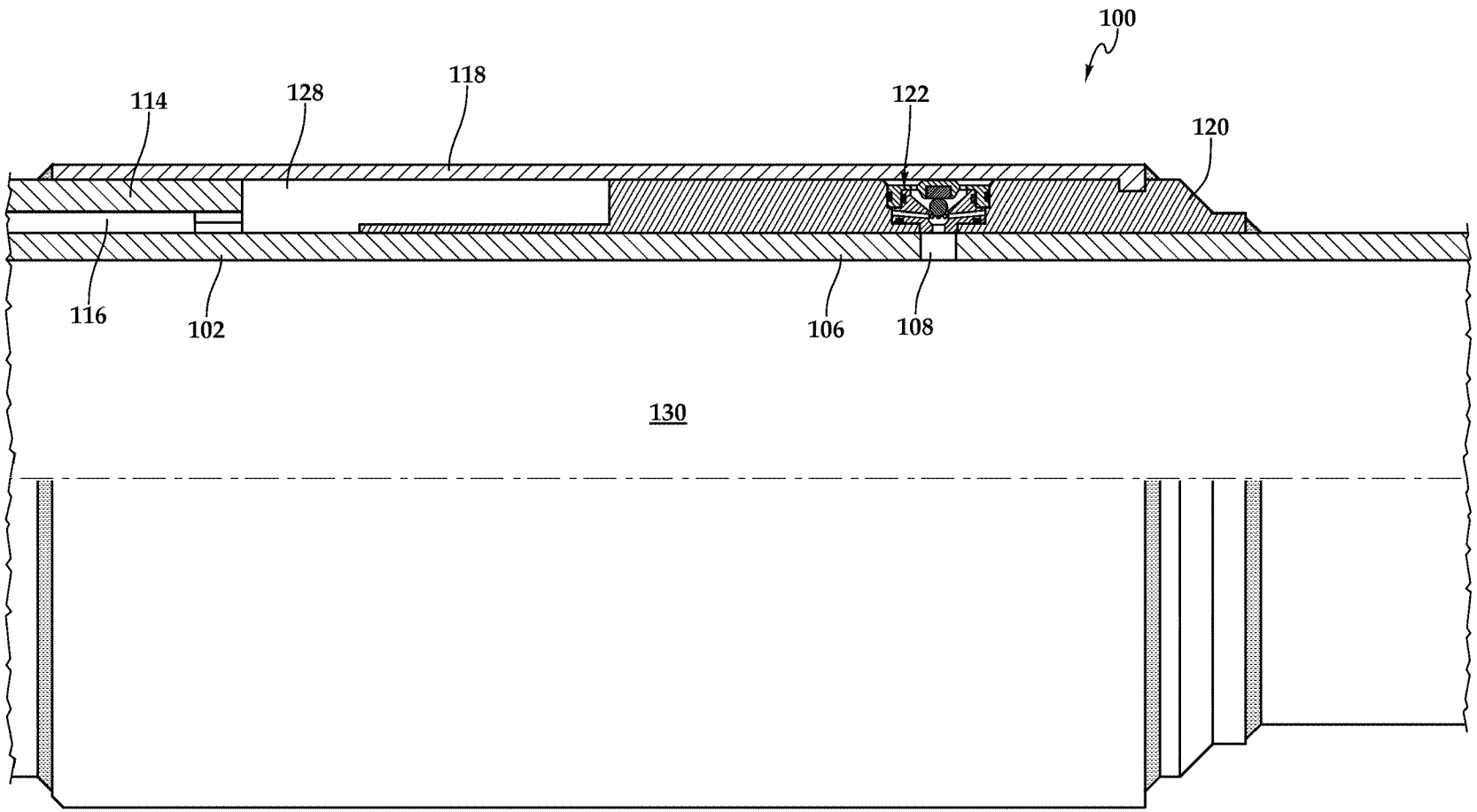

Referring next to FIGS. 2A-2B, therein is depicted successive axial sections of a flow control screen according to an embodiment of the present disclosure that is representatively illustrated and generally designated 100. Flow control screen 100 may be suitably coupled to other similar flow control screens, production packers, locating nipples, production tubulars or other downhole tools to form a completion string such as that described above. Flow control screen 100 includes a base pipe 102 that has a blank pipe section 104 and a perforated section 106 including one or more production ports or openings 108. Positioned around an uphole portion of blank pipe section 104 is a screen element depicted as filter medium 112, that may be a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms an annulus 116 with base pipe 102. Securably connected to the downhole end of screen interface housing 114 is a flow control housing 118. At its downhole end, flow control housing 118 is securably connected to a flow control assembly 120 which is securably coupled to base pipe 102. The various connections of the components of flow control screen 100 may be made in any suitable fashion including welding, threading and the like as well as through the use of fasteners such as pins, set screws and the like. In the illustrated embodiment, flow control assembly 120 houses one or more valves depicted as autonomous closure mechanisms 122 that are preferably aligned with openings 108 as well as one or more inflow control devices 124 having viscosity dependent fluid flow resistance in the form of a positive flowrate response to decreasing fluid viscosity and one or more inflow control devices 126 having viscosity dependent fluid flow resistance in the form of a negative flowrate response to decreasing fluid viscosity, as best seen in FIG. 3.

Even though the figures depicted a particular arrangement of inflow control devices 124, 126 and autonomous closure mechanism 122, it should be understood by those skilled in the art that any number of each of these fluidic components having a variety of individual configurations and a variety of configurations relative to flow control assembly 120 may be used. For example, any number of inflow control devices 124 and/or inflow control device 126 may be circumferentially or longitudinally distributed at uniform or nonuniform intervals about flow control assembly 120. Likewise, inflow control devices 124, 126 may be placed upstream of any number of autonomous closure mechanisms 122, such autonomous closure mechanisms being circumferentially or longitudinally distributed at uniform or nonuniform intervals about flow control assembly 120.

As discussed in greater detail below, autonomous closure mechanism 122 and inflow control devices 124, 126 are operable to control the inflow of fluid during a production operation. In this scenario, fluid flows from the formation into the production tubing through fluid flow control screen 100. The production fluid, after being filtered by filter medium 112, if present, flows into annulus 116. The fluid then travels into an annular region 128 between base pipe 102 and flow control housing 118 before entering the fluid flow path of flow control assembly 120. The fluid then passes through inflow control devices 124, 126 and autonomous closure mechanism 122 where the desired flow control operation occurs depending upon the composition, viscosity and/or other selected fluid property of the produced fluid. If flow is not shut off by autonomous closure mechanism 122, the fluid is discharged through openings 108 to interior flow path 130 of base pipe 102 for production to the surface.

Figure 3:
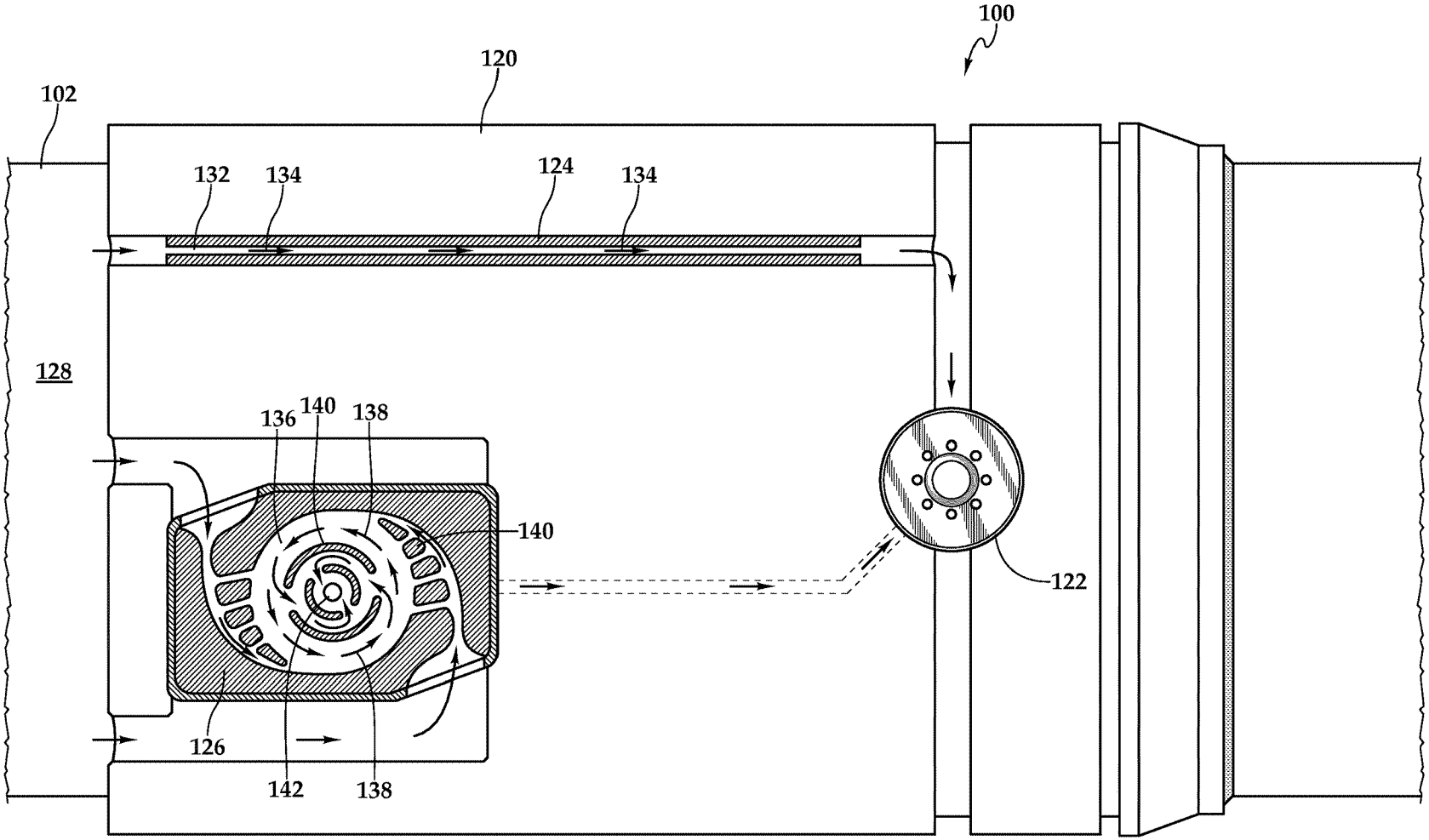
FIG. 3 is a top view of a downhole fluid flow control system according to an embodiment of the present disclosure.

Referring particularly to FIG. 3, a flow control section including flow control assembly 120 of flow control screen 100 is representatively illustrated. It is noted that flow control housing 118 has been removed in FIG. 3 and inflow control devices 124, 126 are shown in cross section to aid in the description of the present disclosure. In the illustrated embodiment, flow control assembly 120 includes autonomous closure mechanism 122 in series with and downstream of inflow control devices 124, 126, which are in parallel with each other, in the fluid flow path of flow control assembly 120. As illustrated, inflow control device 124 is depicted as flow tube 132 that provides resistance to fluid flow therethrough indicated as arrows 134. In the case of a relatively high viscosity fluid composition containing predominately oil, flow through inflow control device 124 encounters relatively high resistance. On the other hand, in the case of a relatively low viscosity fluid composition containing predominately water, flow through inflow control device 124 encounters relatively low resistance. In this example, if oil is a desired fluid and water is an undesired, then it will be appreciated that inflow control device 124 will provide high resistance to fluid flow when the fluid composition has a relatively high ratio of the desired fluid to the undesired fluid, and will provide progressively less resistance as the ratio of the desired fluid to the undesired fluid decreases. Inflow control device 124 thus has viscosity dependent fluid flow resistance and in particular, a positive flowrate response to decreasing fluid viscosity.

As illustrated, inflow control device 126 is depicted as a fluid diode having a vortex chamber 136 that provides resistance to fluid flow therethrough indicated as arrows 138. In the case of a relatively high viscosity fluid composition containing predominately oil, flow through inflow control device 126 may progress relatively unimpeded. On the other hand, in the case of a relatively low viscosity fluid composition containing predominately water, the fluids entering vortex chamber 136 will travel primarily in a tangentially direction and will spiral around vortex chamber 136 with the aid of fluid guides 140 before eventually exiting through opening 142. Fluid spiraling around vortex chamber 136 will suffer from frictional losses. Further, the tangential velocity produces centrifugal force that impedes radial flow. Consequently, spiraling fluids passing through inflow control device 126 encounter significant resistance. As should be understood by those skilled in the art, the more circuitous the flow path taken by the relatively low viscosity fluid composition, the greater the amount of energy consumed. This can be compared with the more direct flow path taken by the relatively high viscosity fluid composition in which a lower amount of energy consumed. In this example, if oil is a desired fluid and water is an undesired, then it will be appreciated that inflow control device 126 will provide low resistance to fluid flow when the fluid composition has a relatively high ratio of the desired fluid to the undesired desired fluid, and will provide progressively greater resistance as the ratio of the desired fluid to the undesired fluid decreases. Inflow control device 126 thus has viscosity dependent fluid flow resistance and in particular, a negative flowrate response to decreasing fluid viscosity.

In the depicted configuration, inflow control device 124 and inflow control device 126 are in parallel in the fluid flow path of flow control assembly 120, sharing a common fluid source, annulus 128, and a common fluid discharge, interior flow path 130. In this configuration, inflow control device 124 and inflow control device 126 have a common upstream pressure and a common downstream pressure. Accordingly, as the resistance to fluid flow through inflow control devices 124, 126 changes, the ratio of the flowrates through inflow control devices 124, 126 will also change. For example, as the oil to water ratio of the production fluid decreases, the viscosity of the fluid also decreases. As described above, as the viscosity of the fluid flowing through inflow control device 124 decreases, the resistance to flow decreases. At the same time, as the viscosity of the fluid flowing through inflow control device 126 decreases, the resistance to flow increases. As the relative resistances change with upstream and downstream pressures being common, the relative flowrates also change. In the depicted configuration, as the oil to water ratio decreases, the ratio of the flowrate through inflow control device 124 to the flowrate through inflow control device 126 increases. In other words, the flowrate through inflow control device 124 become progressively greater relative to the flowrate through inflow control device 126 due to the positive flowrate response to decreasing fluid viscosity of inflow control device 124 and the negative flowrate response to decreasing fluid viscosity of inflow control device 126.

Figure 4C:
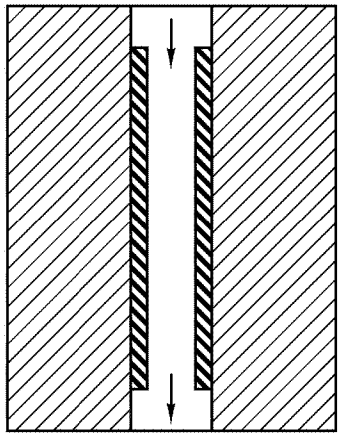
FIGS. 4A-4C are schematic illustration of various embodiments of flow control components having positive flowrate response to decreasing fluid viscosity for use in a downhole fluid flow control system according to an embodiment of the present disclosure.
Figure 4B:
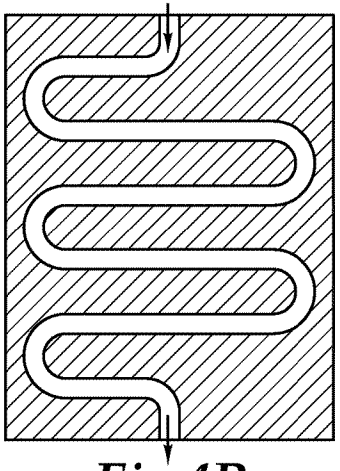
Figure 4A:
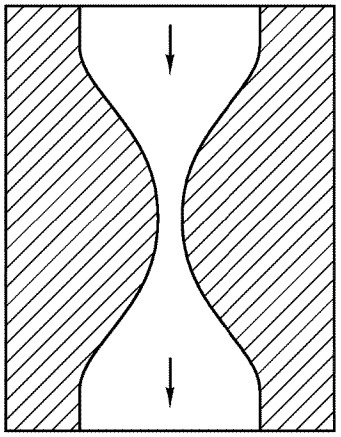
Figure 5C:
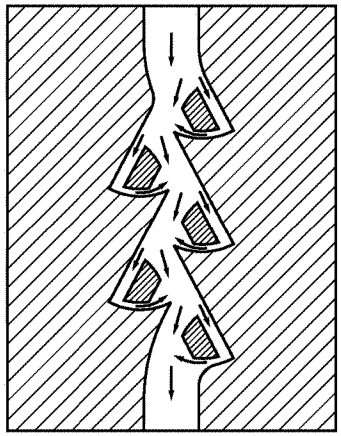
FIGS. 5A-5C are schematic illustration of various embodiments of flow control components having negative flowrate response to decreasing fluid viscosity for use in a downhole fluid flow control system according to an embodiment of the present disclosure.
Figure 5B:
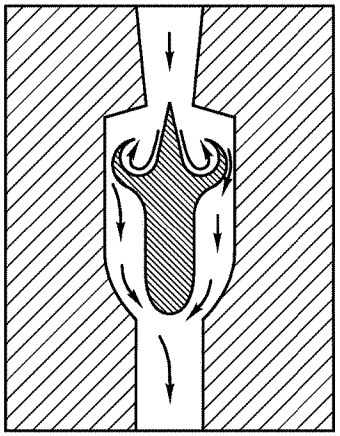
Figure 5A:
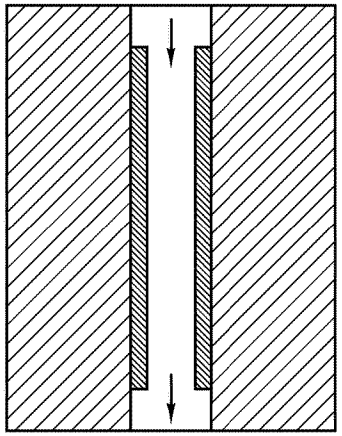

Even though inflow control devices 124, 126 have been depicted and described as having fluid flow resistance depending upon a particular fluid property; namely viscosity, those skilled in the art will recognize that fluid flow resistance of inflow control devices may be dependent upon other fluid properties including, but not limited to, fluid density, fluid velocity, fluid composition and the like without departing from the principles of the present disclosure. In addition, even though inflow control devices 124, 126 have been depicted and described as having particular designs, those skilled in the art will recognize that inflow control devices may having alternate designs without departing from the principles of the present disclosure. For example, an inflow control device having a positive flowrate response to a changing fluid property may alternatively or additionally include other types of fluidic components such as a nozzle, as depicted in FIG. 4A, a tortuous path or labyrinth, as depicted in FIG. 4B, a fluid selector that includes a material that swells when it comes in contact with hydrocarbons, as depicted in FIG. 4C or the like. Likewise, a inflow control device having a negative flowrate response to a changing fluid property may alternatively or additionally include other types of fluidic components such as a fluid selector that includes a material that swells when it comes in contact with water, as depicted in FIG. 5A, a converging nozzle having a fluid disrupter, as depicted in FIG. 5B, a tesla diode or similar fluid diode, as depicted in FIG. 5C or the like.

Figure 6A:
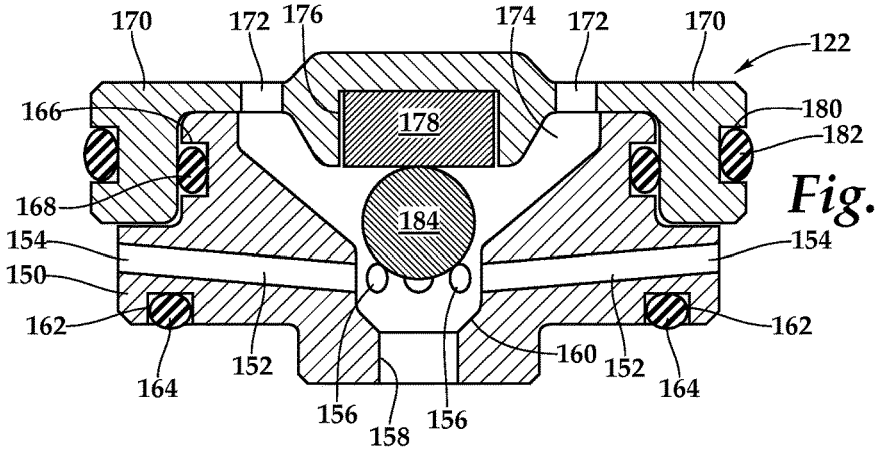
FIGS. 6A-6B are cross sectional views of an autonomous closure mechanism for use in a downhole fluid flow control system according to an embodiment of the present disclosure in its open and closed configurations, respectively.
Figure 6B:
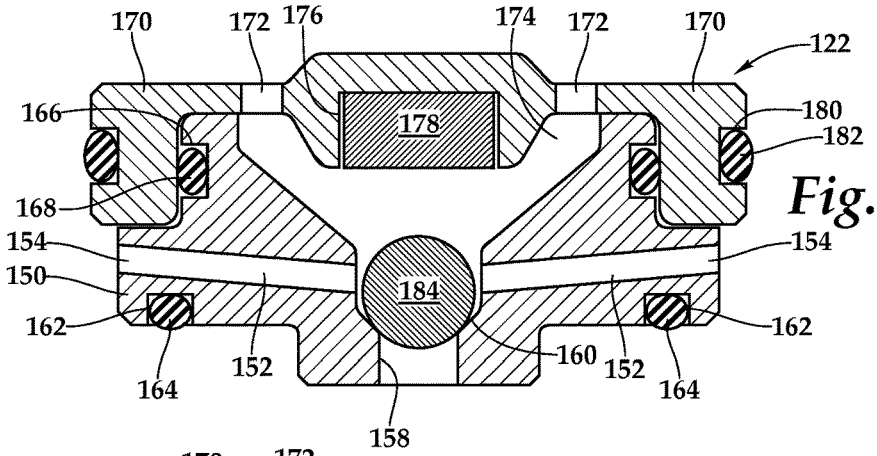
Figure 6C:
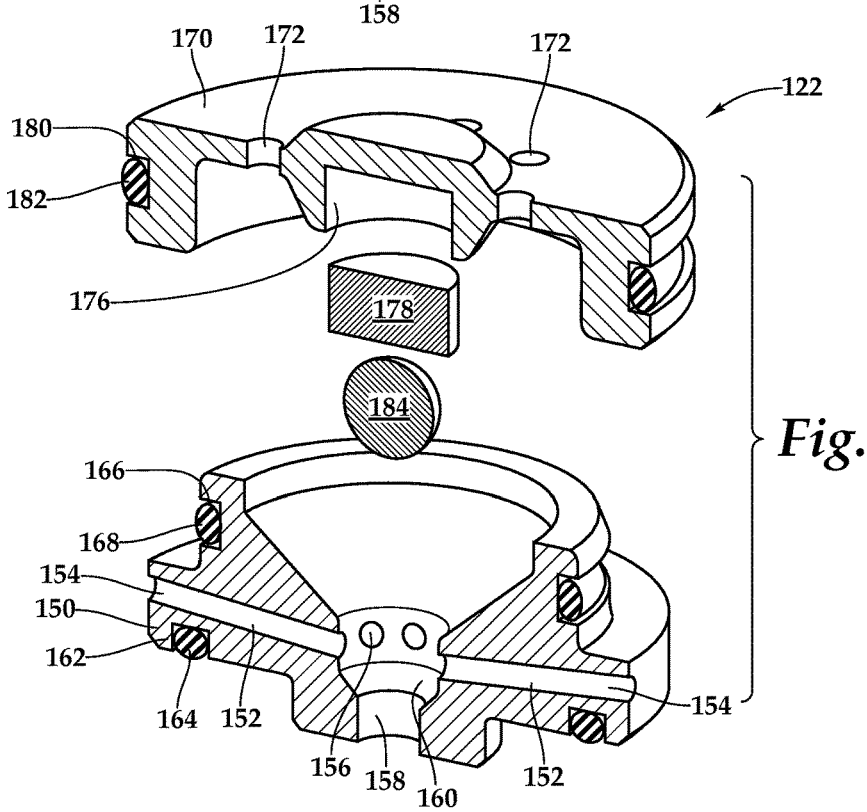
FIGS. 6C is an exploded view depicted in cross section of an autonomous closure mechanism for use in a downhole fluid flow control system according to an embodiment of the present disclosure.

Referring now to FIGS. 6A-6C, therein is depicted various views of an autonomous closure mechanism that is generally designated 122. Autonomous closure mechanism 122 includes a valve body 150. Valve body 150 includes a plurality of circumferentially distributed inlet passageways 152 each having an inlet 154 and an outlet 156. Inlet passageways 152 form a lower inlet path for fluid from inflow control device 126 in the configuration of flow control assembly 120 depicted in FIG. 3. Fluid flowing in inlet passageways 152 travels in substantially radial directions of autonomous closure mechanism 122. Valve body 150 also includes a discharge port 158 that is in fluid communication with openings 108 of base pipe 102, as best seen in FIG. 2B. Between outlets 156 and discharge port 158, valve body 150 defines a valve seat 160. Valve body 150 has an o-ring groove 162 having an o-ring 164 disposed therein and an o-ring groove 166 having an o-ring 168 disposed therein. Sealably positioned around an upper portion of valve body 150 is a valve cap 170. Valve cap 170 includes a plurality of inlets 172 that communicate fluid from inflow control device 124, in the configuration of flow control assembly 120 depicted in FIG. 3, to an upper inlet path 174 disposed between valve cap 170 and valve body 150. Fluid entering upper inlet path 174 travels in a substantially longitudinal direction of autonomous closure mechanism 122. Valve cap 170 includes a recess 176 that has a support assembly depicted as magnet 178 disposed therein. Valve cap 170 has an o-ring groove 180 having an o-ring 182 disposed therein. A plug 184 depicted as a ball is positioned between valve body 150 and valve cap 170. Those skilled in the art will recognize that other types of plugs such as darts or similar non spherical plugs could alternatively be used.

In operation, plug 184 is operable to allow fluid flow through autonomous closure mechanism 122 from inlets 154 and inlets 172 to discharge port 158 when autonomous closure mechanism 122 is in its open position as depicted in FIG. 6A. In this configuration, plug 184 is magnetically supported remote from valve seat 160. Also, in this configuration, fluid flow into autonomous closure mechanism 122 from flow control component 126 generally biases plug 184 away from valve seat 160 as it travels from inlet passageways 152 through outlets 156 to discharge port 158. Fluid flow into autonomous closure mechanism 122 from flow control component 124 however, generally biases plug 184 toward valve seat 160 as it travels from inlets 152 through upper inlet path 174 to discharge port 158. The magnitude and direction of the resultant force biasing plug 184 is related to such factors as the directionality of the fluid impacting plug 184, the density and composition of the fluid impacting plug 184, the flowrate of the fluid impacting plug 184 and the like. In this case, as the density and composition of the fluid is the same from flow control components 124, 126 and the directionality of the fluid impacting plug 184 is generally defined by the shape of valve body 150, valve cap 170 and the flow paths therein, the primary variable that determines the magnitude and direction of the resultant force generated by fluid flow on plug 184 is the ratio of the flowrate from control component 124 to the flowrate from flow control component 126.

As described above, as the viscosity of the fluid flowing through inflow control device 124 decreases, the resistance to flow decreases and as the viscosity of the fluid flowing through inflow control device 126 decreases, the resistance to flow increases such that the flowrate through inflow control device 124 become progressively greater relative to the flowrate through inflow control device 126 due to the positive flowrate response to decreasing fluid viscosity of inflow control device 124 and the negative flowrate response to decreasing fluid viscosity of inflow control device 126. In this example, as the ratio of the flowrate from control component 124 to the flowrate from flow control component 126 increases, the magnitude of the force biasing plug 184 toward valve seat 160 increases. When the ratio reaches a predetermined level, the downward biasing force overcomes the force of the magnetic attraction between plug 184 and magnet 178. When this occurs, plug 184 releases from magnet 178 and is forced against valve seat 160, shifting autonomous closure mechanism 122 from its open position to its closed position, as best seen in FIG. 6B. Once in the closed position, formation pressure acts on plug 184 maintaining autonomous closure mechanism 122 in its closed position. In this manner, as the oil to water ratio of production fluids decreases to a predetermined level, autonomous closure mechanism 122 in combination with inflow control devices 124, 126 is operable to automatically shut off production therethrough. If it is desired to restart production through a flow control system or flow control screen incorporating a flow control assembly including autonomous closure mechanism 122, for example, following a stimulation treatment, tubing pressure can be applied to autonomous closure mechanism 122 to shift plug 184 from valve seat 160 back into contact with magnet 178. In this manner, autonomous closure mechanism 122 can be shifted from the closed position to the open position.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A downhole fluid flow control system comprising:

a flow control assembly having a fluid flow path for a flowing fluid;

a first flow control component disposed in the fluid flow path having a positive flowrate response to decreasing fluid viscosity;

a second flow control component disposed in the fluid flow path in parallel with the first flow control component having a negative flowrate response to decreasing fluid viscosity; and a valve disposed in the fluid flow path in series with and downstream of the first and second flow control components, the valve having a single valve seat, a plug, a discharge port, a first inlet path for fluid from the first flow control component and a second inlet path for fluid from the second flow control component, wherein the single valve seat circumscribes the discharge port and is disposed between the discharge port and both of the first and second inlet paths such that fluid flows through the single valve seat from both of the first and second to the discharge port, wherein, decreasing the fluid viscosity of the flowing fluid increases a ratio of the flowrate through the first flow control component to the flowrate through the second flow control component;

wherein fluid flow into the first inlet path of the valve from the first flow control component biases the plug toward the single valve seat and fluid flow into the second inlet path of the valve from the second flow control component biases the plug away from the single valve seat; and wherein, when the ratio reaches a predetermined level, the valve autonomously shifts from an open position wherein the plug is remote from the single valve seat to a closed position wherein the plug is forced against the single valve seat to prohibit fluid flow through the discharge port.

2. The downhole fluid flow control system as recited in claim 1 wherein the first and second flow control components have viscosity dependent fluid flow resistance.

3. The downhole fluid flow control system as recited in claim 1 wherein the first flow control component is selected from the group consisting of nozzles, flow tubes, labyrinths and fluid selectors.

4. The downhole fluid flow control system as recited in claim 1 wherein the second flow control component is selected from the group consisting of vortex chambers, fluid selectors, fluid disrupters and fluid diodes.

5. The downhole fluid flow control system as recited in claim 1 wherein the valve further comprises a magnet, and wherein the magnet supports the plug remote from the single valve seat when the valve is in the open position.

6. The downhole fluid flow control system as recited in claim 1 wherein the first inlet path further comprises a plurality of first inlet openings and wherein the second inlet path further comprises a plurality of second inlet openings.

7. The downhole fluid flow control system as recited in claim 1 wherein fluid flow into the first inlet path of the valve from the first flow control component enters the valve in at least one substantially longitudinal direction and fluid flow into the second inlet path of the valve from the second flow control component enters the valve in at least one substantially radial direction.

8. The downhole fluid flow control system as recited in claim 1 wherein the plug is supported between the first inlet path and the second inlet path such that the directionality of the fluid impacting plug from the first inlet path and second inlet path biases the plug toward and away from the valve seat, respectively.

9. A flow control screen comprising:

a base pipe with an internal passageway;

a filter medium positioned around the base pipe;

a housing positioned around the base pipe defining a fluid passageway between the filter medium and the internal passageway;

a flow control assembly positioned in the fluid passageway, the flow control assembly having a fluid flow path for a flowing fluid;

a first flow control component disposed in the fluid flow path having a positive flowrate response to decreasing fluid viscosity;

a second flow control component disposed in the fluid flow path in parallel with the first flow control component having a negative flowrate response to decreasing fluid viscosity; and a valve disposed in the fluid flow path in series with and downstream of the first and second flow control components, the valve having a single valve seat circumscribing a discharge port, a plug, a first inlet path for fluid from the first flow control component and a second inlet path for fluid from the second flow control component, wherein, decreasing the fluid viscosity of the flowing fluid increases a ratio of the flowrate through the first flow control component to the flowrate through the second flow control component;

wherein fluid flow into the first inlet path of the valve from the first flow control component biases the plug toward the single valve seat and fluid flow into the second inlet path of the valve from the second flow control component biases the plug away from the single valve seat; and wherein, when the ratio reaches a predetermined level, the valve autonomously shifts from an open position wherein the plug is remote from the single valve seat and fluid flow is permitted through the valve from both the first and second inlet paths, to a closed position wherein the plug is forced against the single valve seat to prohibit fluid flow through the valve.

10. The flow control screen as recited in claim 9 wherein the first and second flow control components have viscosity dependent fluid flow resistance.

11. The flow control screen as recited in claim 9 wherein the valve further comprises a magnet, wherein the magnet supports the plug remote from the single valve seat when the valve is in the open position.

12. The flow control screen as recited in claim 9 wherein the first inlet path further comprises a plurality of first inlet openings and wherein the second inlet path further comprises a plurality of second inlet openings.

13. The flow control screen as recited in claim 9 wherein fluid flow into the first inlet path of the valve from the first flow control component enters the valve in at least one substantially longitudinal direction and fluid flow into the second inlet path of the valve from the second flow control component enters the valve in at least one substantially radial direction.

14. A downhole fluid flow control method comprising:

positioning a fluid flow control system at a target location downhole, the fluid flow control system including a flow control assembly having a fluid flow path for a flowing fluid, first and second flow control components disposed in parallel in the fluid flow path, the first flow control component having a positive flowrate response to decreasing fluid viscosity and the second flow control component having a negative flowrate response to decreasing fluid viscosity and a valve disposed in the fluid flow path in series with and downstream of the first and second flow control components, the valve having a valve seat, a plug and first and second inlet paths for fluid from the first and second flow control components, respectively;

flowing fluid through the fluid flow path of the flow control assembly through the first and second flow control components and the valve;

biasing the plug toward the valve seat responsive to fluid flow into the first inlet path of the valve from the first flow control component and biasing the plug away from the valve seat responsive to fluid flow into the second inlet path of the valve from the second flow control component;

decreasing the fluid viscosity of the flowing fluid;

increasing a ratio of the flowrate through the first flow control component to the flowrate through the second flow control component;

reaching a predetermined ratio of the flowrates;

autonomously shifting the valve from an open position to a closed position;

maintaining the valve in the closed position by forcing the plug in a direction toward the valve seat with fluid from the first inlet path and by forcing the plug in the direction toward the valve seat with fluid from the second inlet path such that fluid flow through the valve is prohibited; and maintaining the valve in the open position by magnetically supporting the plug remote from the valve seat of the valve, wherein the valve seat is a single valve seat of the valve circumscribing a discharge port of the valve.

15. The method as recited in claim 14 wherein decreasing the fluid viscosity of the flowing fluid further comprises decreasing an oil to water ratio of the flowing fluid.

16. The method as recited in claim 14 further comprising flowing fluid into a plurality of first inlet openings of the first inlet path and flowing fluid into a plurality of second inlet openings of the second inlet path.

17. The method as recited in claim 14 further comprising flowing fluid in at least one substantially longitudinal direction into the first inlet path of the valve from the first flow control component and flowing fluid in at least one substantially radial direction into the second inlet path of the valve from the second flow control component.

18. The method as recited in claim 14 further comprising flowing fluid into the valve to shift the plug from the valve seat.

* * * * *